US007631766B2

(12) United States Patent
Wang

(10) Patent No.: US 7,631,766 B2
(45) Date of Patent: Dec. 15, 2009

(54) COSMETIC MASK PACKAGE

(75) Inventor: Chu-Hui Wang, Taipei (TW)

(73) Assignee: Wei-Hsuan Tseng, Taipei (TW)

( * ) Notice: Subject to any disclaimer, the term of this patent is extended or adjusted under 35 U.S.C. 154(b) by 0 days.

(21) Appl. No.: 12/107,942

(22) Filed: Apr. 23, 2008

(65) Prior Publication Data

US 2009/0173658 A1 Jul. 9, 2009

(30) Foreign Application Priority Data

Jan. 8, 2008 (TW) ..... 97200405 U

(51) Int. Cl.
*B65D 71/00* (2006.01)

(52) U.S. Cl. ..... 206/581; 206/222; 206/438; 206/823

(58) Field of Classification Search ..... 206/219, 206/222, 438, 440, 363, 581, 205, 207, 210, 206/823

See application file for complete search history.

(56) References Cited

U.S. PATENT DOCUMENTS 3,596,801 A * 8/1971 Barnack ..... 222/81
4,353,463 A * 10/1982 Seemann ..... 206/220
5,368,158 A * 11/1994 Miaud ..... 206/222

* cited by examiner

*Primary Examiner*—Jacob K Ackun, Jr.
(74) *Attorney, Agent, or Firm*—Rabin & Berdo, P.C.

(57) ABSTRACT

A cosmetic mask package has an outer pouch, a liquid storing device and a carrier. The outer pouch has an interior surface defining an inner space. The liquid storing device is mounted in the inner space inside the outer pouch and has an inner pouch filled with liquid and a pointed instrument selectively piercing the inner pouch to release the liquid. The carrier is dry to prevent microorganism growth and is mounted in the inner space inside the outer pouch and outside the inner pouch. When the inner pouch is pierced, the carrier is moistened for use. Additional preservatives are not required so the masks are hypoallergenic and hygienic.

12 Claims, 5 Drawing Sheets

COSMETIC MASK PACKAGE

BACKGROUND OF THE INVENTION

1. Field of the Invention

The present invention relates to a package for cosmetic mask, particularly a cosmetic mask package with two partitions for accommodating a liquid and a dried carrier respectively.

2. Description of the Prior Arts

With virtual universal usage of cosmetic products in modern society, various vessel, containers and packages have been designed to accommodate different cosmetic products designed to satisfy different requirements of cosmetic products.

Cosmetic masks, such as facial masks, eye masks, hand masks and foot masks are for daily skin care and comprise a carrier impregnated with a liquid cosmetic composition. For convenience, current cosmetic mask products are prepared by impregnating a carrier in a solution containing a cosmetic composition, packing the carrier into a foil or plastic bag and sealing the bag. The carrier is ready for use once the removed from the bag.

However, cosmetic mask products packaging under a normal atmosphere tend to be contaminated by microorganisms. Furthermore, the carrier impregnated with the liquid cosmetic composition is a very suitable breeding ground for microorganisms. Therefore, preservatives are usually added to prevent the current cosmetic products from rancidification, oxidation and decomposition. However, some people are allergic to or find preservatives undesirable so a preservative free or low preservative-content cosmetic mask is required.

To overcome the shortcomings, the present invention provides a cosmetic mask package to mitigate or obviate the aforementioned problems.

SUMMARY OF THE INVENTION

The main objective of the invention is to provide a cosmetic mask package having a pierceable inner pouch to separate a liquid from a dry carrier mounted around the inner pouch.

The cosmetic mask package comprises an outer pouch, a liquid storing device and a carrier.

The outer pouch has a stationary edge, at least one sealed edge, and an interior surface. The interior surface defines an inner space.

The liquid storing device is mounted in the inner space inside the outer pouch and has an inner pouch and a pointed instrument.

The inner pouch is mounted in the inner space and has a stationary edge, a target edge and an inner surface. The stationary edge is attached to the interior surface of the outer pouch. The target edge is opposite to the stationary edge. The inner surface defines a chamber for accommodating a liquid.

The pointed instrument is mounted in the chamber inside the inner pouch and has a sharp being formed at one end of the pointed instrument adjacent to the target edge and selectively pierces the inner pouch to selectively release the liquid.

The carrier is mounted in the inner space inside the outer pouch and outside the inner pouch is dry and is hydrated when the liquid is released for hygienic use with little or no preservative.

Other objectives, advantages and novel features of the invention will become more apparent from the following detailed description when taken in conjunction with the accompanying drawings.

DETAILED DESCRIPTION OF THE PREFERRED EMBODIMENTS

Figure 1:
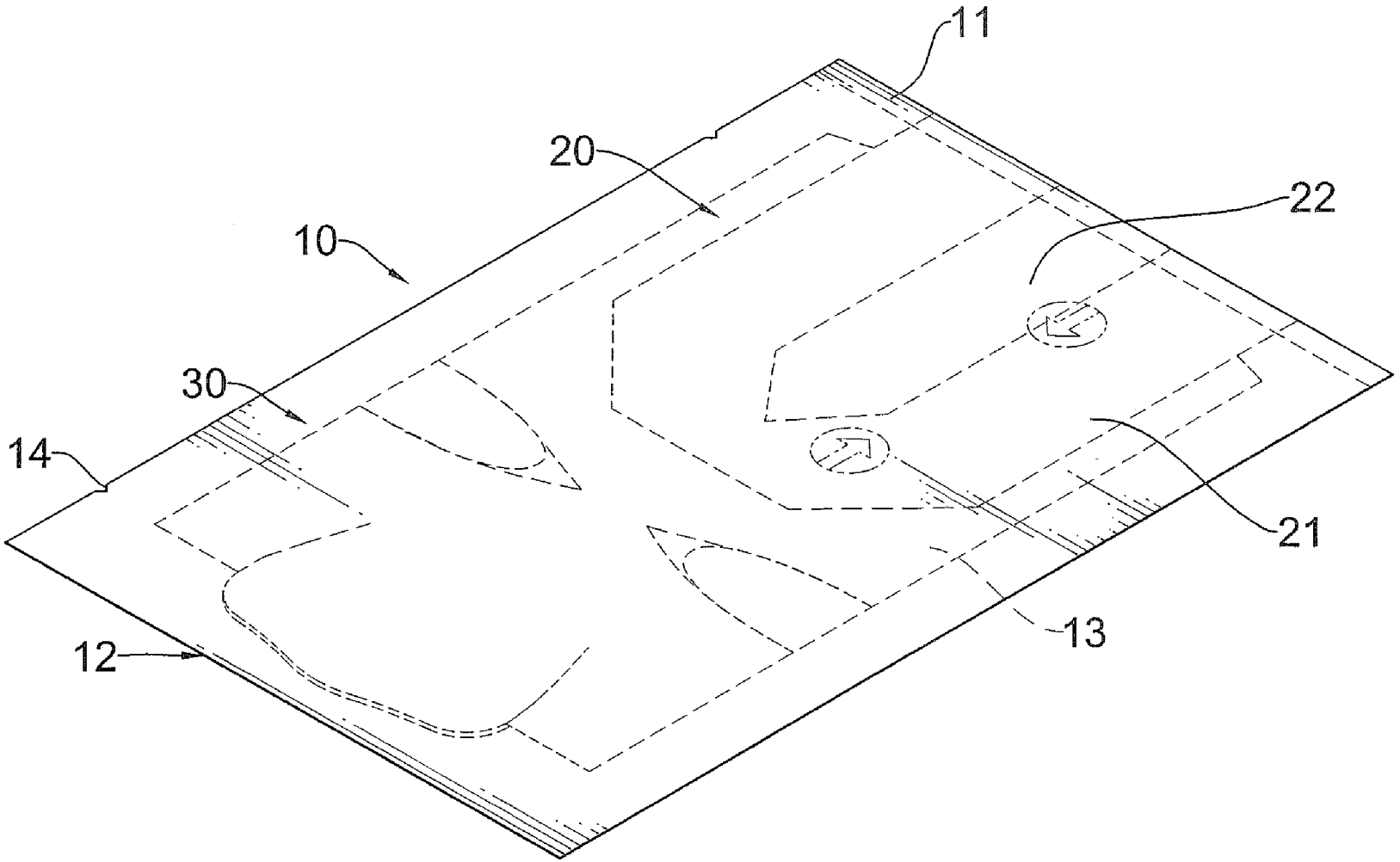
FIG. 1 is a perspective view of a cosmetic mask package in accordance with the present invention with internal elements shown in phantom lines.
Figure 2:
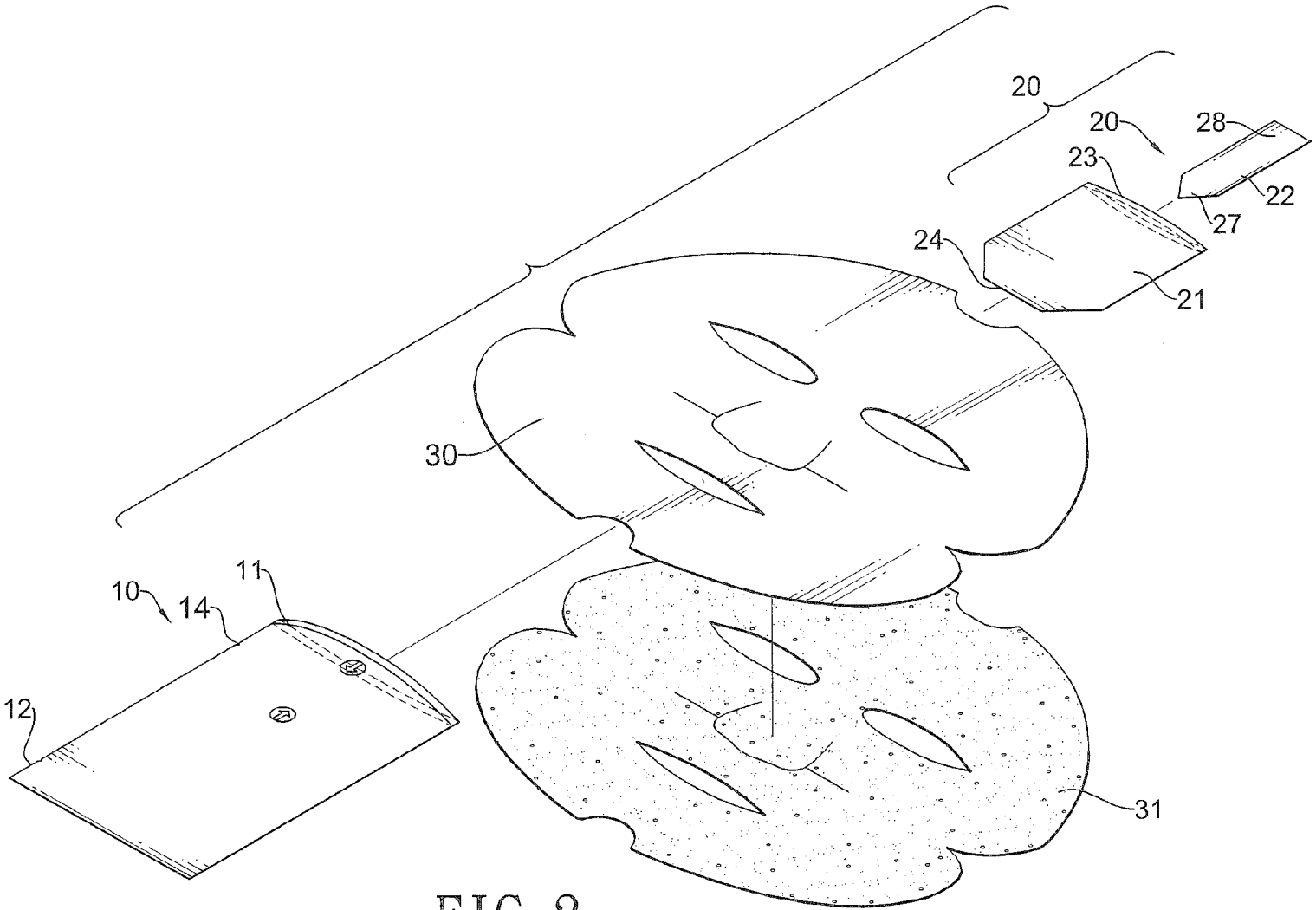
FIG. 2 is an exploded perspective view of the cosmetic mask package in FIG. 1.

With reference to FIGS. 1 and 2, a cosmetic mask package in accordance with the present invention comprises an outer pouch (10), a liquid storing device (20), a carrier (30), an optional support membrane (31) and an optional dried cosmetic composition.

The outer pouch (10) may be made from an impermeable material such as but not limited to foil, polyethylene (PE) or a mixture thereof and has a stationary edge (11), at least one sealed edge (12), an interior surface and at least one optional notch (14). The interior surface of the outer pouch (10) defines an inner space (13). The at least one notch (14) is formed in the at least one sealed edge (12) of the outer pouch (10) for easy opening of the outer pouch (10) by hand.

Figure 3:
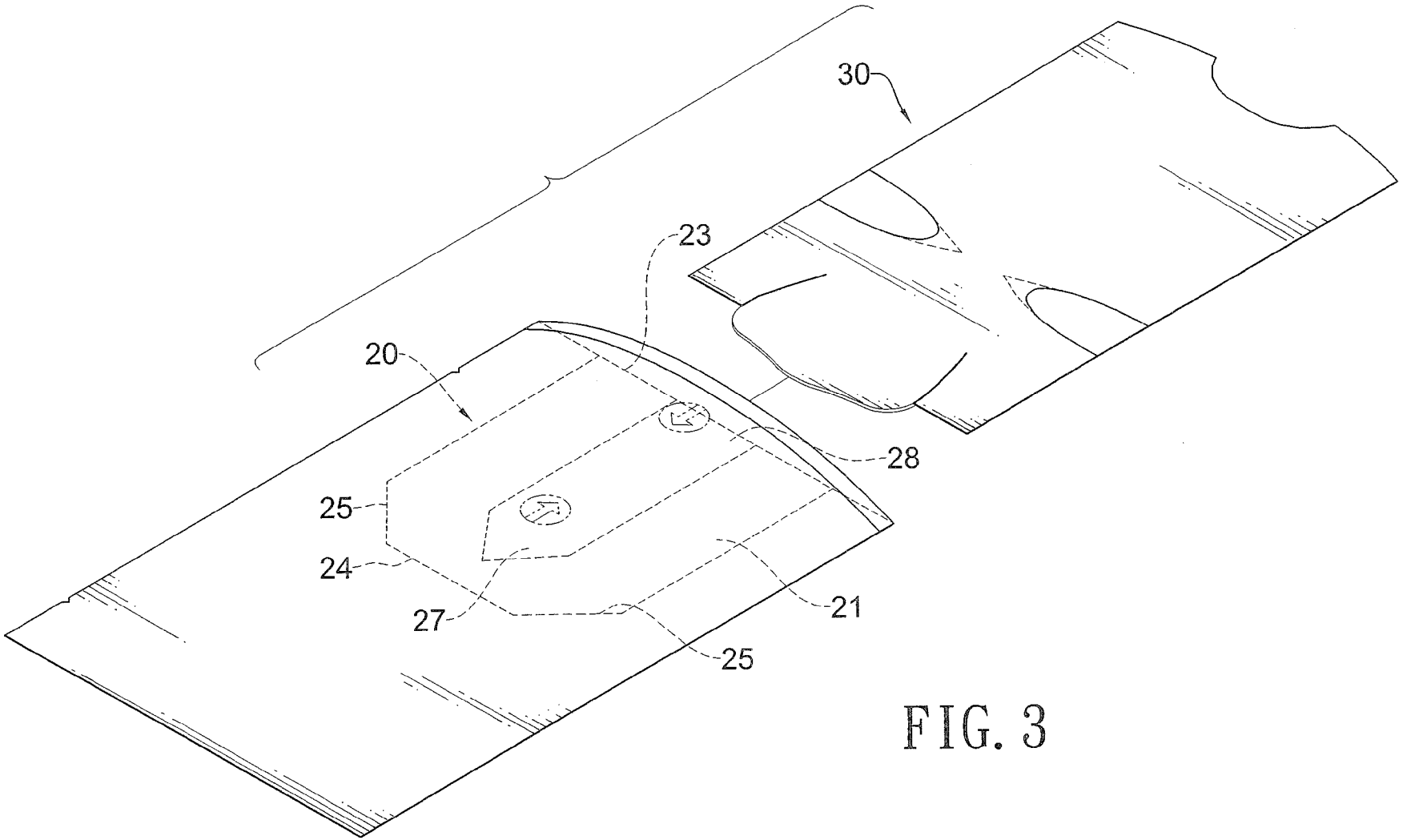
FIG. 3 is a partially exploded perspective view of the cosmetic mask package in FIG. 1 with internal elements shown in phantom lines.
Figure 4:
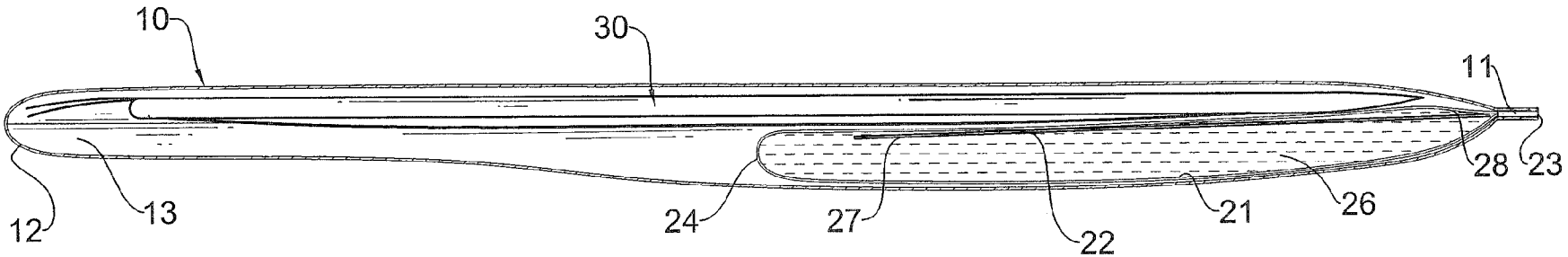
FIG. 4 is a cross sectional side view of the cosmetic mask package in FIG. 1.

With further reference to FIGS. 3 and 4, the liquid storing device (20) is mounted in the inner space (13) inside the outer pouch (10) and has an inner pouch (21) and a pointed instrument (22).

The inner pouch (21) is mounted in the inner space (13) inside the outer pouch (10), has a stationary edge (23), a target edge (24), two optional side edges (25) and an inner surface and may be hexagonal. The stationary edge (23) of the inner pouch (20) is attached to the interior surface of the outer pouch (10), may be mounted on the stationary edge (11) of the outer pouch (10) and has a length. The target edge (24) is opposite to the stationary edge (23), is mounted in the inner space inside the outer pouch (10) and has a length. The length of the stationary edge (23) may be longer than the length of the target edge (24). The side edges (25) extend from the stationary edge (23) to the target edge (24) and may be parallel, may be convergent or each side edge (25) may comprise a parallel segment and a convergent segment. The inner surface of the inner pouch (21) defines a chamber (26) for storage of a liquid being, but not limited to, distilled water, sterile water and saline solution.

The pointed instrument (22) is rigid under a liquid environment, is mounted in the chamber (26) inside the inner pouch (21), has a distal end (27) and a stationary end (28) and may be plastic, laminated wood or paper. Preferably, the pointed instrument (22) is plastic, for example, but not limited to polyethylene (PE) or polypropylene (PP). The distal end (27) has at least one sharp portion. The sharp portion is formed on the distal end (27) adjacent to the target edge (24) of the inner pouch (23). The stationary end (28) may be attached to the inner surface of the inner pouch (21) near the stationary edge (23) or may be mounted on the stationary edge (23) of the inner pouch (21).

The carrier (30) is mounted in the inner space (13) inside the outer pouch (10) and outside the inner pouch (21) and may be wrapped around the inner pouch (21). The carrier (30) may be made from an absorbent material, for example, but not limited to natural fibers and fabricated fibers, and may be cotton, paper-made fabrics or non-woven textiles and may be prepared in a shape corresponding to a portion of the human body for application thereon, such as a face, eye socket, hand or the like.

The dried cosmetic composition contains at least one active skin nutrient, for example, but not limited to, pearl powder, collagen, vitamin C and biocompatible salts thereof. The dried cosmetic composition may be in a powder form and dispersed on the carrier (30) or in the inner space (13) inside the outer pouch (10). The dried cosmetic composition may be applied to the carrier (30) by impregnating the carrier (30) into a solution containing the cosmetic composition followed by drying the carrier (30).

With reference to FIGS. 2 and 3, the support membrane (31) is folded with the carrier (30) and mounted in the inner space (13) inside the outer pouch (10) and may be wrapped around the inner pouch (21) of the liquid storing device (20). The support membrane (31) may be a sheet of foil or polyethylene (PE).

The inner pouch (20) and outer pouch (10) may be formed from a single sheet.

Figure 5:
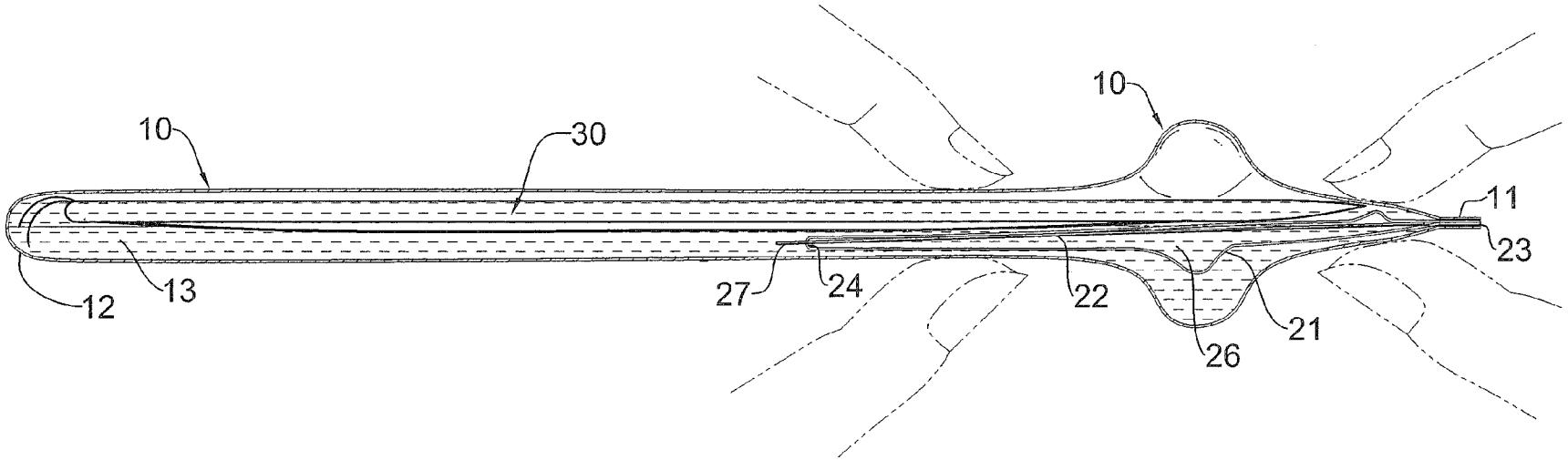
FIG. 5 is a cross sectional side view of the cosmetic mask package in FIG. 1 being used.

With further reference to FIG. 5, to use, the stationary end (28) of the pointed instrument (22) is pinched with one hand through the outer pouch (10) and the inner pouch (21) held by another hand, then the inner pouch (21) is twisted or concertinaed to force the stationary edge (23) and the target edge (24) closer. Therefore, the pointed instrument (22) pierces the inner pouch (21) such that liquid inside the inner pouch flows through the inner pouch (21) and enters the inner space (13) of the outer pouch (10).

Furthermore, the inner pouch (21) with two side edges being convergent allow smooth flow and little of the liquid will remain inside the inner pouch (21). Moreover, the support membrane (31) can prevent the carrier (30) from being pierced by the pointed instrument (22). The outer pouch (10) can easily be torn open by the notch (14) to remove the carrier (30) for use.

Based on the aforesaid, the carrier (30) of the cosmetic mask package in accordance with the present invention is kept in a dry condition during storage and transportation. This reduces possibility of propagation of microorganisms in the carrier (30) since microorganisms grow very slowly or not at all under dry conditions. Accordingly, when in use, the cosmetic mask package in accordance with the present invention requires little or no preservative for prolonging the shelf life.

To keep the liquid accommodated in the liquid storing device (20) from being contaminated, it can be sealed in the inner pouch (21) of the liquid storing device (20) by any technique as known in the field of the present invention, such as thermal sealing technique and be sterilized. Alternatively, the liquid as well as the liquid storing device (20) can be previously sterilized by heat treatment, UV treatment or by adding a sterilizing agent such as salt to prevent microorganism growth in the inner pouch (20) before being filled in the inner pouch (21) under a sterile environment.

Therefore, the cosmetic mask package in accordance with the present invention need not be packaged under sterile condition during packaging. Consequently, the cost of packaging of a cosmetic mask can be significantly reduced whilst maintaining high quality of goods and without adding chemical preservatives.

Even though numerous characteristics and advantages of the present invention have been set forth in the foregoing description, together with details of the structure and features of the invention, the disclosure is illustrative only. Changes may be made in the details, especially in matters of shape, size, and arrangement of parts within the principles of the invention to the full extent indicated by the broad general meaning of the terms in which the appended claims are expressed.

What is claimed is:

1. A cosmetic mask package comprising an outer pouch having a first stationary edge, at least one sealed edge, and an interior surface defining an inner space;

a liquid storing device mounted in the inner space and having a hexagonal inner pouch mounted in the inner space, the inner pouch having a second stationary edge attached to the interior surface of the outer pouch and mounted on the first stationary edge, a target edge opposite to the second stationary edge and mounted in the inner space of the outer pouch, an inner surface defining a chamber for storage of a liquid, and two side edges extending from the stationary edge to the target edge of the inner pouch and being convergent, and a pointed instrument being rigid under a liquid environment and mounted in the chamber inside the inner pouch, the pointed instrument having a distal end having at least one sharp portion formed thereon and located adjacent to the target edge of the inner pouch, and a stationary end mounted on the second stationary edge of the inner pouch;

a carrier mounted in the inner space inside the outer pouch and wrapped around the outside of the inner pouch; and a support membrane folded with the carrier and mounted in the inner space inside the outer pouch.

2. The cosmetic mask package as claimed in claim 1, wherein the outer pouch further has at least one notch being formed respectively in the at least one sealed edge of the outer pouch.

3. The cosmetic mask package as claimed in claim 1, wherein the carrier is made from an absorbent material.

4. The cosmetic mask package as claimed in claim 1, wherein the pointed instrument is plastic.

5. The cosmetic mask package as claimed in claim 1, wherein the outer pouch is made from an impermeable material.

6. The cosmetic mask package as claimed in claim 5, wherein the impermeable material is selected from the group consisting of foil, polyethylene and a mixture thereof.

7. The cosmetic mask package as claimed in claim 1, wherein each of the side edges of the inner pouch comprises a parallel segment and a convergent segment.

8. The cosmetic mask package as claimed in claim 1, wherein the carrier is made from natural fibers or fabricated fibers.

9. The cosmetic mask package as claimed in claim 1, wherein the carrier is made from a material selected from the group consisting of cotton, paper-made fabrics and non-woven textiles.

10. The cosmetic mask package as claimed in claim 1, further comprising a dried cosmetic composition containing at least one active skin nutrient and being dispersed on the carrier.

11. The cosmetic mask package as claimed in claim 1, further comprising a dried cosmetic composition containing at least one active skin nutrient and being dispersed in the inner space inside the outer pouch.

12. The cosmetic mask package as claimed in claim 1, further comprising a dried cosmetic composition containing at least one active skin nutrient and being applied to the carrier by impregnating the carrier into a solution containing the cosmetic composition followed by drying the carrier.

* * * * *